US012601186B2

(12) United States Patent
Shaw

(10) Patent No.: US 12,601,186 B2
(45) Date of Patent: Apr. 14, 2026

(54) FLOOR PANEL AND METHODS FOR MANUFACTURING FLOOR PANELS

(71) Applicant: Aladdin Manufacturing Corporation, Calhoun, GA (US)

(72) Inventor: Aaron Shaw, High Point, NC (US)

(73) Assignee: Aladdin Manufacturing Corporation, Calhoun, GA (US)

( * ) Notice: Subject to any disclaimer, the term of this patent is extended or adjusted under 35 U.S.C. 154(b) by 302 days.

(21) Appl. No.: 18/037,659

(22) PCT Filed: Nov. 23, 2021

(86) PCT No.: PCT/US2021/060586
§ 371 (c)(1),
(2) Date: May 18, 2023

(87) PCT Pub. No.: WO2022/115462
PCT Pub. Date: Jun. 2, 2022

(65) Prior Publication Data
US 2023/0407648 A1 Dec. 21, 2023

Related U.S. Application Data

(60) Provisional application No. 63/117,802, filed on Nov. 24, 2020.

(51) Int. Cl.
*E04F 15/04* (2006.01)
*E04F 15/02* (2006.01)

(52) U.S. Cl.
CPC ..... *E04F 15/042* (2013.01); *E04F 15/02038* (2013.01); *E04F 2201/0552* (2013.01)

(58) Field of Classification Search
CPC ... E04F 13/0835; E04F 13/0866; E04F 15/00; E04F 15/02188; E04F 15/107; E04F 15/042; E04F 15/02038; E04F 2201/0552; B32B 3/266; B32B 3/30; B32B 9/002; B32B 9/045; B32B 27/304; B32B 2307/744; B32B 419/04; B32B 7/022;
(Continued)

(56) References Cited

U.S. PATENT DOCUMENTS 5,755,068 A 5/1998 Ormiston
2005/0136234 A1 6/2005 Hak
(Continued)

FOREIGN PATENT DOCUMENTS

DE 10245914 A1 4/2004
DE 202013012020 U1 2/2015
(Continued)

OTHER PUBLICATIONS

International Search Report and Written Opinion for Application No. PCT/US2021/060586 dated Mar. 8, 2022.

*Primary Examiner* — Chi Q Nguyen
(74) *Attorney, Agent, or Firm* — KDW FIRM PLLC

(57) ABSTRACT

A floor panel with a substrate, a decorative layer of wood veneer with a thickness of 1 millimeter or less on the substrate, and a lacquer layer including transparent or translucent surface material on the wood veneer. The lacquer layer can have hard particles. The lacquer layer can extend from the upper surface of the wood veneer at least up to a side edge of the wood veneer, such that the side edge is at least partially covered by the lacquer layer.

21 Claims, 5 Drawing Sheets

(58) Field of Classification Search
CPC ..... B32B 7/06; B32B 27/08; B32B 27/365; B32B 27/40; B32B 2307/7376; B32B 2307/51; B32B 2419/00
See application file for complete search history.

(56) References Cited

U.S. PATENT DOCUMENTS

| | | | | |
|---|---|---|---|---|
| 2006/0070325 | A1 | 4/2006 | Magnusson | |
| 2009/0252925 | A1* | 10/2009 | Provoost | B44C 3/025 428/151 |
| 2017/0036424 | A1* | 2/2017 | Chan | B32B 21/042 |
| 2019/0210330 | A1* | 7/2019 | Ziegler | B32B 27/10 |
| 2020/0308846 | A1* | 10/2020 | Josefsson | E04F 13/076 |
| 2020/0353722 | A1 | 11/2020 | Naeyaert | |
| 2021/0363759 | A1* | 11/2021 | Baert | E04F 13/0866 |
| 2022/0243482 | A1* | 8/2022 | Landgård | B32B 21/13 |
| 2022/0274131 | A1* | 9/2022 | Pervan | B05D 1/36 |
| 2023/0407648 | A1* | 12/2023 | Shaw | E04F 15/042 |
| 2025/0001738 | A1* | 1/2025 | Baert | B32B 5/18 |
| 2025/0019972 | A1* | 1/2025 | Baert | E04F 13/0875 |
| 2025/0128503 | A1* | 4/2025 | Baert | B29C 48/0021 |

FOREIGN PATENT DOCUMENTS

| | | | | |
|---|---|---|---|---|
| EP | 1851020 | B1 | 7/2011 | |
| EP | 2013034 | B1 | 6/2014 | |
| EP | 2805778 | A1 | 11/2014 | |
| WO | 9713626 | A1 | 4/1997 | |
| WO | 9747834 | A1 | 12/1997 | |
| WO | 0151732 | A1 | 7/2001 | |
| WO | 0175247 | A1 | 10/2001 | |
| WO | 2010122514 | A2 | 10/2010 | |
| WO | 2011141849 | A2 | 11/2011 | |
| WO | 2015078434 | A1 | 6/2015 | |
| WO | 2015105456 | A1 | 7/2015 | |
| WO | 2017001976 | A1 | 1/2017 | |
| WO | 2017009744 | A1 | 1/2017 | |
| WO | 2017188883 | A1 | 11/2017 | |
| WO | WO2019/135141 | * | 12/2018 | B32B 7/12 |
| WO | WO-2019135141 | A1 * | 7/2019 | B32B 21/02 |

* cited by examiner

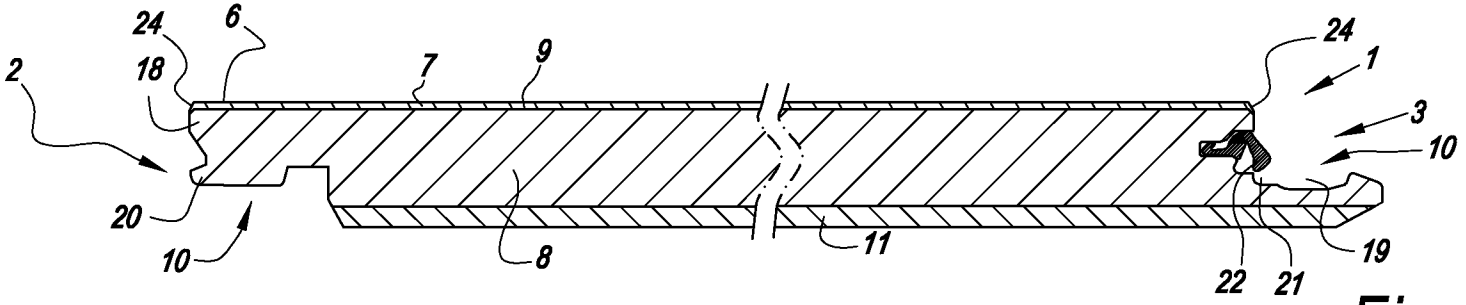
Fig. 4
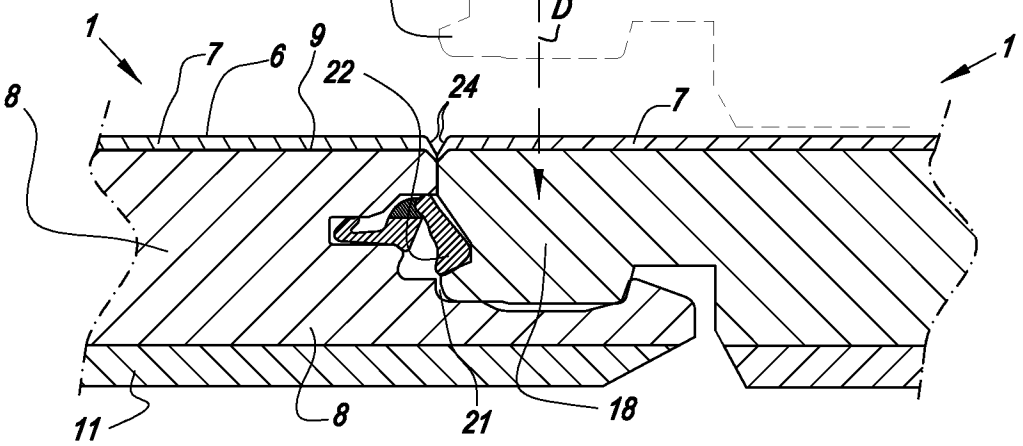
Fig. 5
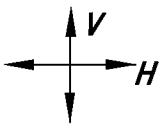

FLOOR PANEL AND METHODS FOR MANUFACTURING FLOOR PANELS

CROSS-REFERENCE TO RELATED APPLICATION

This application claims priority to U.S. Provisional Patent Application Ser. No. 63/117,802, which was filed on Nov. 24, 2020, the disclosure of which is incorporated herein by reference in its entirety.

TECHNICAL FIELD

This invention relates to a floor panel, as well as to a method for manufacturing floor panels.

BACKGROUND

More particularly, the invention relates to decorative panels, such as floor panels, which comprise a top layer or decorative layer on the basis of wood. Such panels are widely known as such, for example, from WO 2010/122514. In the case of floor panels, it concerns ready-to-lay, prefabricated or composed parquet, in English also indicated as "Engineered Wood Parquet", or about veneer parquet. The present invention is directed in particular to floor panels for veneer parquet, namely, to floor panels with a wooden top layer with a thickness of 1 millimeter or less.

Floor panels for veneer parquet are described, for example, in U.S. Pat. No. 5,755,068 and usually comprise at least a substrate and a glued thereon wood veneer of less than 2 millimeters. According to the EN 13489 standard, panels with a wooden top layer of 2.5 millimeters and more can be called multi-layered parquet or "multilayer parquet" and are not considered veneer parquet. With panels for veneer parquet, a wood-based backing layer can be glued to the underside of the substrate as well. The wood layer situated at the upper side functions as a top and decorative layer and mostly is realized from hardwood. It may in fact be treated further at its upper side, for example, in order to exert an influence on the appearance thereof and/or in order to improve the surface quality thereof, for example, via coloring, applying a wear-resistant and/or waterproof lacquer, and so on. The wood-based backing layer mostly consists of a unitary thin layer of a cheap and mostly soft wood species. Such veneer parquetry panels are sensitive to impressions by impact and can be scratch-sensitive. Due to their insufficient mechanical features, soft wood species are unusable as top layer for such panels. At the end-side edges of the veneer, there is a risk of penetration of moisture, and circular spots may show on the veneer surface.

From DE 102 45 915, it is known, for the top layer of veneer parquet, to glue a wood veneer impregnated with thermosetting resin on an MDF or HDF substrate, printing it and finishing it with a wear-resistant lacquer. For the resin, use is made of phenolic resin or melamine resin. US 2006/070,325 and US 2005/136,234 describe a method wherein a wooden top layer of 2 millimeters or more is glued under pressure on an MDF/HDF substrate, wherein a certain impregnation of the applied glue in the wooden top layer is obtained. DE 20 2013 012 020 U1 and WO 2015/078434 describe a method wherein a wooden veneer layer with a thickness between 0.6 mm and 1.2 mm is pressed, via an intermediate resin layer, on an MDF/HDF substrate in a hot press. The intermediate resin layer can comprise a thermosetting resin. The panels known from the aforementioned documents still show a limited wear resistance.

From WO 2017/009744 and WO 2017/001976, it is known that veneers of soft wood species can be compressed such that they become suitable as a decorative top layer for a veneer parquet. From WO 2017/001976, WO 2015/105456 and WO 2017/188883 it is further known to apply aluminum oxide particles in order to increase the wear resistance of the panels. According to W'456 and WO'883, a permeation of a colored mixture of glue and hard particles towards the surface of the veneer is intended, namely through pores, cracks and knots, by which pores and defects are filled up or repaired. In that the glue mixture colors the surface at least at the location of the pores and defects, the techniques of W'456 and WO'883 are suited primarily for manufacturing rather rustic veneer parquets.

From WO 2019/135141 it is known to provide large hard particles underneath the veneer, such that in the finished products these particles penetrate the veneer from the bottom side. An increased abrasion resistance is obtained.

SUMMARY

The present invention primarily aims at an alternative panel for veneer parquet, wherein according to various preferred embodiments solutions are offered for the problems with the floor panels of the state of the art.

To this aim, in accordance with a first independent aspect, the present invention relates to a floor panel with a substrate and a provided thereon decorative layer of wood veneer with a thickness of 1 millimeter or less, wherein a lacquer layer, preferably comprising transparent or translucent surface material is provided, on said wood veneer, with as a characteristic that said lacquer layer comprises hard particles and extends from the upper surface of the wood veneer at least up to a side edge of said wood veneer, such that said side edge is at least partially covered by said lacquer. The lacquer layer brings an increased wear and/or scratch resistance to the floor panel, while its presence on the side edge of the wood veneer increases the water resistance of the wood veneer. The lacquer has the ability of sealing the edges of the wood veneer. This is especially advantageous when the relevant veneer edge is obtained by a cross cut through the veneer. Such cross cut may comprise open wood grain vessels. These vessels tend to suck in water or other liquids due to capillary effects, which then again leads to discoloration of the veneer. The portion of the lacquer on the side edge of the veneer may seal such vessels.

Preferably the entire relevant side edge of the veneer is covered by said portion of the lacquer. Preferably at least two opposite side edges of the veneer are at least partially covered, or preferably entirely covered by said lacquer. Preferably at least the two cross cut edges of the veneer are partially or wholly covered. Of course, it is not excluded that the veneer would be covered at all side edges by said lacquer.

Preferably, said lacquer layer comprises in itself at least two sublayers, wherein preferably at least the uppermost or only the uppermost of said at least two sublayers at least partially covers said side edge. This preferred embodiment allows for a fluent application and/or a minimized interference with the adjoining of floor panels in a floor covering.

Preferably the uppermost of said at least two sublayers is thinner than the other of said two sublayers, wherein preferably only said uppermost of said at least two sublayers is available on said side edge of said veneer. In accordance with this embodiment a good adjoining of floor panels can be maintained.

Preferably said hard particles comprise first hard particles in said uppermost sublayer, and second hard particles in the other of said two sublayers. In accordance with a variant, said uppermost sublayer comprises said hard particles, while the other of said two sublayers is free from hard particles. The particles or first particles contained in said uppermost sublayer have a more immediate effect on abrasion and scratches, while the particles, or second particles, potentially contained in the other sublayer come into play after some wear has already taken place, i.e. when the uppermost layer has been worn out.

Preferably, said second hard particles have an average particle size that is larger than the average particle size of said first hard particles, wherein preferably the average particle size of said second hard particles is at least 2 times larger than the average particle size or said first hard particles. With this embodiment, the smaller particles, that are more effective for scratch resistance, are available more immediately than the larger particles that are more effective for abrasion resistance.

Preferably, said first hard particles have an average particle size of 30 micron or below, preferably of 15 micron or below. An average particle size of micron or of 1 micron and below are not excluded. Preferably, said second hard particles have an average particle size of 120 micron or below, preferably of 85 micron or below, but preferably above 30 micron. In selecting the second hard particles in this range, the second hard particles may stay effectively invisible while delivering a high abrasion resistance.

Preferably, said decorative layer is provided on the substrate by a glue layer which is situated between the substrate and the decorative layer, wherein said glue layer preferably comprises third hard particles. Preferably said third hard particles have an average particle size which is at least one third of the thickness of the wood veneer, and still better with an average particle size which is at least one half or two thirds of the thickness of the wood veneer. It is clear that the thickness of the wood veneer herein relates to the thickness in the floor panel itself and not the thickness of the wood veneer before it is provided on the floor panel. As known from the state of the art, for example, from WO 2017/009744 and WO 2017/001976, namely a considerable compression of the wood veneer may be created when gluing or pressing it onto the substrate. The large hard particles which are applied within the scope of the present invention can limit the known compression of the wood veneer. This is advantageous from an economic point of view, as the client expects a certain thickness of the veneer.

To the person skilled in the art of the technical field, it is clear that the average particle size is determined via the technique of sieve analysis. Said sieve analysis uses a stack of sieves, wherein these sieves comprise raster openings of different size. Of course, the raster openings have to be chosen in accordance with the precision which is desired, and in function of the estimated particle size. Preferably, the stack can be composed by diminishing the size of the openings of the raster of the sieves from top to bottom. The sieve analysis is performed on dry particles. The sieve analysis can be performed either manually or by machine. At the end of the sieve analysis, from an initial sample, on each sieve a fraction of particles remains, with a size that is larger than the raster opening of the respective sieve and smaller than the raster opening of the preceding sieve. The weight of the remaining particle fraction is measured per sieve. The result of said sieve analysis thus is a weight distribution, wherein for each sieve, namely for the range of particle sizes corresponding to the raster openings between two adjacent sieves, the absolute weight in particles is registered.

The average particle size is calculated as the volumetric average particle size by recalculating the absolute weight of each range of particle sizes, as obtained from the aforementioned sieve analysis, to an absolute volume of each particle size on the basis of the density of the particles. From the absolute volume of a range of particle sizes, on the basis of the volume of one particle with the respective particle size (the average between the lower limit and the upper limit of the respective range) the number of particles with the respective particle size is calculated. On the basis of the calculated number of particles and the absolute volume for each particle size, the average particle volume of the respective sample is calculated. From the respective average particle volume, with the fictitious assumption that the particles are spherical, the volumetric average particle size is calculated.

In the cases where the third hard particles show an average particle size which is at least one third of the thickness of the wood veneer, it is guaranteed that these particles can penetrate to a not negligible extent into the underside of the veneer, by which a reliable barrier against excessive wear can be created. So, for example, the third hard particles, or at least the most important fraction thereof, for example, more than 30% by weight or more than 50% by weight of the present particles, can penetrate into the veneer from the underside over a distance of at least 20% of the thickness thereof.

Preferably, the third hard particles, or anyhow at least 30% by weight of the third hard particles which are present, penetrate from the underside into the veneer. Preferably, these particles penetrate into the veneer from on the underside over a distance of at least 50% of the thickness thereof, or even of at least 75% of the thickness thereof.

Preferably, at least 40 particles per square centimeter, and still better at least 100 particles per square centimeter, penetrate into the veneer over a distance of at least 20% of the thickness thereof, and still better of at least 50% of the thickness thereof.

Preferably, less than 1 particle per square centimeter completely penetrate through the veneer, such that always an undisturbed or hardly disturbed veneer layer is maintained, wherein knots, cracks and other defects in the veneer are not taken into consideration.

Preferably, the floor panel of the invention comprises more than 30 grams per square meter of third hard particles underneath the veneer, which then, in accordance with the invention, show an average particle size of more than a third of the thickness of the veneer. Preferably, the content of third hard particles underneath the veneer is between 35 and 70 grams per square meter, wherein 40 to 50 grams per square meter is the most interesting from several points of view.

Preferably, the present glue of the glue layer also penetrates into the veneer from the underside, however, preferably nowhere further than over a distance which is smaller than 50% of the thickness thereof, and still better smaller than 20% of the thickness thereof. In this manner, it is obtained that when, due to wear of the veneer floor, the barrier of the penetrating hard particles is reached, the glue is not visible yet. Glue often leads to a discoloration of the veneer. By the present preferred embodiment, it is avoided that thus discoloration would be visible at an early stage. A discoloration which is visible too early would lead to a premature wear inacceptable to the user.

Preferably, the aforementioned substrate, at the surface where the decorative layer is situated, has a density of more than 900 kilograms per cubic meter. In this manner, it is obtained that the third hard particles preferentially penetrate into the veneer and not into the substrate.

Preferably, the aforementioned substrate is a wood fiberboard, more particularly of the type MDF (Medium Density Fiberboard) or HDF (High Density Fiberboard). However, it is not excluded that other board materials are employed for the substrate. Preferably, these board materials show a high density at least at their surface. So, for example, a mineral-bonded board can be chosen for, such as a cement fiberboard, a magnesite board or the like. According to another possibility, with similar effect, a plastic board based on rigid PVC (polyvinylchloride) or having a rigid PVC layer at its surface can be opted for. The rigid PVC may for example be PVC with less than 5 phr plasticizer. Such board or layer may contain fillers such as calciumcarbonate and/or sand, in a content of 40 to 85 percent by weight.

Preferably, the aforementioned glue layer is layer on the basis of thermosetting resin, preferably ureum-based resin, such as ureumformaldehyde resin. According to a variant melamine-based or phenol-based resin can be used. According to another variant mixtures of the aforementioned resins can be used, such as ureumformaldehyde resin with an addition of melamine. In the latter case a more moisture resistant resin is obtained. With a thermosetting resin, a very reliable connection between the substrate and the wood veneer can be obtained, wherein the third hard particles are well embedded. Preferably, the resin is hardened by a press treatment, for example, with a pressure of 10 bar or more, or even of 20 bar or more, such that by this press treatment the penetration of the third hard particles into the underside of the veneer can be obtained as well. As already mentioned, the aforementioned wood veneer preferably is at least partially impregnated by the aforementioned thermosetting resin. The wood veneer shows such impregnation preferably from the underside up to a certain depth in the wood veneer, wherein this depth is smaller than 50% of the thickness of the wood veneer and preferably is smaller than the average penetration depth of the hard particles.

A choice of a glue layer of melamine-based resin is advantageous in view of limiting the risk of coloring the veneer. Other thermosetting resins, such as ureum formaldehyde-based resins, lignosulfonate-based resins or furane-based resins have a brownish color, which can darken the natural color of the veneer, although this is not excluded in the scope of the invention. Certainly when the impregnation of the glue on the underside of the veneer is limited, it may be economically advantageous to still employ these light-colored resins.

According to variants, it is not excluded that the glue layer comprises a glue on the basis of polyurethane, hot-melt adhesive ("hotmelt") or polyvinyl acetate ("PVAc").

Preferably, the aforementioned glue layer, preferably a glue layer on the basis of a thermosetting resin, extends uninterruptedly underneath the entire wood veneer. According to this embodiment, it is avoided that due to expansion of the wood veneer bubbles are created in the surface of the floor panel, and it is obtained that the aforementioned third hard particles everywhere are bonded at least to a certain extent in the glue layer.

Preferably, the aforementioned wood veneer at the upper side of the floor panel has a thickness between 0.3 and 1 millimeter, preferably between and 0.7 millimeter, for example approximately 0.6 millimeters. The potential third hard particles may then have an average particle size of 100 microns or more, and preferably smaller than 1000 microns, or still better between 300 and 1000 microns, but preferably not larger than the thickness of the veneer. To the person skilled in the art, it is clear that the average particle size is measured by sieve analysis.

The material of the aforementioned hard particles preferably has a hardness of 7 or more on the Mohs scale and/or is preferably chosen from the list of aluminum oxide, titanium carbide, silicon carbide and silicon oxide. In the most preferred embodiment, hard particles of aluminum oxide or so-called corundum are applied.

Preferably, hard particles of the angular type (angular format) are employed.

In accordance with the invention, said decorative layer comprises a lacquer with transparent or translucent surface material at the surface. According to a particular possibility, the transparent or translucent surface material is obtained at least on the basis of a polyurethane-based and/or acrylate-based lacquer, for example, a lacquer with at least 25 percent by weight, or still better at least 50 percent by weight of acrylates chosen from the list consisting of polyurethane acrylates, polyester acrylates and/or epoxide acrylates. Preferably, it relates to a lacquer which is cured with UV radiation, electron beam or excimer radiation. This may relate, for example, to surface material which is provided by an inert coating-system. Such systems are known, for example, from EP 2 805 778. Herein, a lacquer is cured by radiation, for example, UV radiation, through a transparent press element, for example, through a transparent press belt or press foil. Preferably, with the surface material a matte surface is obtained, namely a surface with a gloss degree of 10 or less, as measured according to DIN 67530. The gloss degree of the surface can be obtained, for example, by an excimer-cured lacquer layer. With excimer-cured lacquer layers, the gloss degree even can be adjusted by setting the energy impinging on the surface material to be cured. According to a variant, the gloss degree of the surface can also be obtained by an inert coating-system, wherein the structure of the applied press element, preferably a press foil, determines the gloss degree. Of course, it is also possible to obtain a glossy surface with the surface material, for example, a surface with a gloss degree of 20 or more, as measured according to DIN 67530. Preferably, the transparent surface material contains 15 to 30 percent by weight of hard particles, such as particles of corundum (Aluminum oxide) and/or silica (Silicon oxide). Herein, this may relate to particles with an average particle size of 50 micrometers or smaller, or even of 10 micrometers or smaller, wherein it is not excluded that particles might be used having an average particle size situated between 100 nanometers and 1 micrometer. To the person skilled in the art, it is clear that the average particle size is measured by sieve analysis. Such particles can increase the scratch resistance of the surface. The thickness of the surface material preferably is 0.05 millimeters or less. Preferably, the surface material follows a possible relief present at the surface of the wood veneer, for example, at least possibly present lower edges and preferably also at least a portion of the wood pore structure of the veneer. Preferably, the surface material extends layer-shaped over at least 80 percent of the surface of the veneer layer, and still better over the entire or almost the entire surface thereof.

Preferably, said floor panel comprises 5 to 50 grams per square meter, and even better 5 to 25 grams per square meter of hard particles above the wood veneer, wherein preferably said first hard particles are available in an amount smaller than said second hard particles.

The veneer surface may have an oil finish wherein the oil penetrates into the veneer to a certain extent. The lacquer layer which in accordance with the invention covers at least a side edge of the wood veneer, is in such case present on top of the oil finished veneer.

The invention preferably is applied with floor panels which can be applied for composing a floating floor covering. Preferably, the floor panels to this aim, on at least two opposite edges, are provided with coupling structure(s) allowing that two of such floor panels can be coupled to each other in a vertical direction perpendicular to the plane of the coupled panels and in a horizontal direction in this plane and perpendicular to the respective edge. Such coupling structure(s) are known as such, for example, from WO 97/47834. According to an important first possibility hereof, the coupling structure(s) at two opposite edges preferably are realized substantially as a tongue and a groove with locking parts which prevent the moving apart of the tongue and groove. Such locking parts can consist, for example, of an upwardly projecting locking element at the lower groove lip, wherein this locking element borders a recess in the lower groove lip, and a protrusion, cooperating with this locking part, at the underside of the tongue, wherein this protrusion fits in the aforementioned recess. Such coupling structure(s) may be present at both pairs of opposite edges, in the case of a rectangular floor panel, and/or may allow for a coupling of two such floor panels by an angling motion around the respective edge, and/or by a substantially horizontal motion of two such floor panels towards each other. According to an important second possibility thereof, the coupling structure(s) at two opposite edges are realized as a male part and a female part, wherein the male part can be provided in the female part by a downward movement, wherein the male part and the female part hook into each other, such that a locking in the horizontal direction is obtained. Preferably, the male and female part further also comprise blocking structure(s), whether or not made in one piece, which can come into a position wherein a removal of the male part in vertical direction out of the female part is prevented. Such coupling structures are known as such, for example, from WO 01/75247 or WO 01/51732. In the case of a rectangular panel, preferably, such coupling structure(s) are present at one pair of opposite edges, while the other pair of opposite edges is provided with coupling structure(s) that at least allow for a coupling by an angling motion around the respective edge. Preferably the pair of edges allowing for the coupling by an angling motion form the long pair of edges of a rectangular flooring panel.

Preferably, said third hard particles, when available, have an average particle size that is larger than the average particle size of said first hard particles, wherein preferably the average particle size of said third hard particles is at least 3 times larger than the average particle size or said first hard particles.

As mentioned above, said third hard particles preferably have an average particle size which is at least one third of the thickness of the wood veneer, and preferably less than the thickness or even less than two thirds of the thickness of the wood veneer.

Preferably, said third hard particles have an average particle size above 100 micron or above 120 micron, and preferably above 180 micron, or above 200 micron.

As mentioned above, said third hard particles preferably comprise particles penetrating into the aforementioned wood veneer at the underside over a distance of at least 20% of the thickness of the aforementioned wood veneer. Preferably, the third hard particles penetrate for 30% by weight or more of the aforementioned third hard particles at the underside into the aforementioned wood veneer over a distance of at least 20% of the thickness of the aforementioned wood veneer.

The material of the aforementioned first, second and/or third hard particles, when available, is preferably chosen from the list of aluminum oxide, titanium carbide, silicon carbide and silicon oxide.

The aforementioned substrate, at the surface where the decorative layer is situated, preferably has a density of more than 900 kilograms per cubic meter.

With the same aim as in the first independent aspect, the present invention, according to its second independent aspect, also relates to a method for manufacturing floor panels, wherein these floor panels comprise at least a substrate and a provided thereon decorative layer of wood veneer, wherein the method comprises at least the following steps:

the step of providing a basic board;

the step of composing a stack which comprises at least the basic board, a glue layer, third hard particles and one or more wood veneers;

the step of pressing said stack, wherein the aforementioned veneers are adhered to the basic board;

with as a characteristic that the aforementioned third hard particles have an average particle size which is at least one third of the thickness of the wood veneer, and in that said third hard particles are provided by scattering the particles in or on said glue layer. Preferably, said glue layer is liquidly applied to said basic board, for example by one or more rollers. It is clear that the method of the second independent aspect is preferably applied for manufacturing the preferred embodiments of the floor panels of the first independent aspect where third hard particles are applied.

With the same aim as in the first and second aspect, the present invention, in accordance with a third independent aspect is a method for manufacturing floor panels, whether or not in accordance with the second independent aspect, wherein these floor panels comprise at least a substrate and a provided thereon decorative layer of wood veneer, wherein the method comprises at least the following steps:

the step of providing a basic board;

the step of composing a stack which comprises at least the basic board, a glue layer and one or more wood veneers;

the step of pressing said stack, wherein the aforementioned veneers are adhered to the basic board;

the step of dividing the pressed stack into a plurality of panels, and potentially profiling the edges of the obtained panels, wherein the aforementioned veneers are cross cut;

with as a characteristic that, subsequent to said step of dividing and potentially subsequent to said step of profiling, a lacquer layer comprising transparent or translucent surface material is provided directly or indirectly on said wood veneer, wherein said lacquer layer preferably comprises first hard particles, and extends from the upper surface of the wood veneer at least up to a side edge of said wood veneer, preferably said side edge is created with said cross cut. It is clear that the method of the third independent aspect is ideally suitable for manufacturing the floor panels of the first independent aspect, and/or the preferred embodiments thereof. Said step of profiling may comprise a milling edge for providing a profile comprising a coupling mean as described above, and/or for realizing the pertaining upper edge of the floor panel. It is clear that said lacquer layer is preferably provided on said side edge, after said side edge of the wood veneer had been profiled to its final shape, position or dimension. In that manner any lacquer applied to said side edge may remain during subsequent manufacturing steps in order to create a floor panel with the features of the first independent aspect. Preferably said lacquer layer is provided by one or more rollers. Preferably, the side edge to be at least partially covered by said lacquer is a cross cut edge of said veneer, for example available at one or both edges of a pair of opposite short edges in the case of rectangular panels. Preferably, the side edge to be coated is a trailing or a leading edge of the panels while being transported through the respective coating apparatus, for example through the one or more rollers.

The first hard particles are preferably mixed into the lacquer to be applied, while the third hard particles, when available, are preferably separately provided in a still wet glue layer applied to the basic board. With "still wet" it is meant that the glue layer has not completely cured. It may either be in an entirely wet state, i.e. with as much moisture as immediate after application, or in a partially dried state, i.e. where a part of the moisture has already been evaporated, for example by a forced drying operation. The partial drying of the glue layer may bring a thermosetting resin, used as the glue, in a so-called B-stage. This is a semi-cured state, where the resin is solid but may still be made fluid and further cured by heat application.

Also the second hard particles, when available, may be mixed in a lacquer to be applied.

As mentioned in the introduction, a floor panel in accordance with the invention may comprise a lacquer layer that contains at least two sublayers. It is clear that, in the case the lacquer layer comprises at least two sublayers, that these sublayers may be separately applied. The uppermost sublayers may be applied after division and, potentially profiling, while the other of the two sublayers may be applied before or after division and, potentially profiling.

By the pressing step in the second and/or third independent aspect, the glue layer may be cured and the potential third hard particles can penetrate into the veneer from the underside. As already mentioned within the scope of the first aspect, such effect is maximally obtained when the basic board has a high density at the surface, such as a density of 900 kilograms per cubic meter or more.

There, where according to the second and/or third independent aspect a plurality of veneers are included in the stack, this preferably relates to veneers which are situated next to each other and not one above the other. Preferably such veneers are attached adjacently by glueing and/or sewing. Preferably the seam between two adjacent veneers is positioned in the stack such that a subsequent dividing operation is performed at least at the position of the seam, and removes material at the seam. In this manner the presence of seams in a final floor panel can be avoided.

Preferably, for the glue layer a thermosetting resin is provided and the press treatment relates to a heated press treatment. Preferably, in the method of the invention also one or more of the following measures are taken:

- a thermosetting resin, for example, a ureum-based and/or melamine-based resin, can be used, which hardens at a press temperature of less than 150° C. or even of less than 120° C. In this manner, the risk of discoloration of the wood veneer by the thermal influence of the press is limited. Such hardening temperature can be obtained by adding sufficient hardener, such as by adding PTSA (p-toluene sulfonic acid) or other acidic hardeners to the melamine-based resin;
- the pressing time can be shorted by hardening the present thermosetting resin on the board to a B-stage before providing the veneer in the stack. This measure also leads to a limitation of the amount of moisture which can have an influence on the press treatment and/or the wood veneer during the press treatment.
- the basic board can be pre-heated, by which a shortening of the pressing time can be obtained as well, and thus a limitation of the exposure of the veneer to the press temperature;
- in the stack, between the present thermosetting resin and the veneer, a moisture-absorbing layer can be provided, for example, a layer which at least comprises silica particles. This may relate, for example, to a mixture of a binder, such as PVA (Polyvinyl alcohol) and silica. Such layer can take up the moisture still present in the resin as well as the moisture created by the hardening reaction of the resin. In this manner, bubble formation is avoided and the influence of water and steam on the wood veneer during the press treatment is minimized,
- a thermosetting resin with a residual moisture content of less than percent, for example, of approximately 7 percent, can be applied. A low residual moisture content is advantageous during pressing and reduces the risk of the occurrence of defects in the decorative top layer. An excessive amount of water namely may lead to that the veneer layers are affected and/or that the decorative layer may burst open due to a too high vapor pressure in the intermediate resin layer.

In accordance with some embodiments, the floor panels of the first aspect, or the floor panels obtained through the second and/or third aspect of the invention may show the characteristic that said wood veneer comprises one or more defects such as wood knots and/or cracks. Preferably these defects are repaired with filler, such as wood paste, e.g. by the known, primarily manual, techniques. Preferably such is done prior to the application of the lacquer layer, such that said lacquer layer also covers said filler. Preferably, such filler comprises pigments or other colorants. It also may contain, for example, wood dust. Preferably, the filler which is applied contains a similar glue as the aforementioned glue layer, such that, e.g. during pressing or after pressing, a good bond can be formed between the fillings and the substrate. Preferably, the glue as well as the filler contain ureum-based and/or melamine-based resin.

It is noted that, the third hard particles, when available, can also penetrate from the underside into the fillings of the defects, such that on those locations, too, a barrier against excessive wear is obtained.

Further, it is also noted that, according to preferred embodiments of all aspects, a floor panel may be obtained with a substrate and a provided thereon decorative layer of wood veneer with a thickness of 2 millimeters or less, or still better of 1 millimeter or less, wherein the aforementioned substrate has an average density of more than 750 kilograms per cubic meter, and that the aforementioned decorative layer is provided on the substrate by a layer on the basis of thermosetting resin situated between the substrate and the decorative layer. The combination of a high average density of the substrate and a gluing of the wood veneer on the basis of a thermosetting resin leads to a veneer parquet with high impact resistance. The underlying substrate with high density functions as a buffer for impression deformations or perforations exerted on the thin veneer, as the intermediate resin layer forms a relatively hard connection between the veneer and the substrate.

As aforementioned, the substrate in all aspects preferably, at least at the surface where the decorative layer is situated, shows a density of more than 900 kilograms per cubic meter, or even of more than 1000 or 1100 kilograms per cubic meter. Preferably, herein this relates to a density increased locally at the surface, whereas the core of the substrate shows a density which is lower than average, for example, less than 800 or less than 750 kilograms per cubic meter. The combination of a high surface density with a lower internal density leads to an optimum between impact resistance and sound absorption in the use of a veneer parquet composed of the panels of the invention. Preferably, the aforementioned substrate is a wood fiberboard, more particularly of the type HDF. Herein, this may relate to a HDF board which is glued by ureum formaldehyde, melamine formaldehyde or melamine-ureum formaldehyde. According to another possibility, this HDF board is glued by pMDI. pMDI or polymeric methylene diphenyl diisocyanate has a certain resiliency and in this manner can contribute to the impact resistance of the floor panel. Preferably, the aforementioned substrate has a swelling of less than 15% as measured according to EN 317:1993. Preferably, the aforementioned substrate has a thickness between 5 and 15 millimeters and still better between 6 and 10 millimeters.

According to a preferred embodiment of all aspects, the aforementioned floor panel is provided with lower edge regions on one or more edges, wherein the aforementioned wood veneer extends in one piece from on the surface of the substrate over the aforementioned lower edge regions. As the veneer extends up to a lower-situated region at the edge of the floor panel, an increased wear resistance is obtained at these edges. A direct impact or directly walking on the edge of the veneer then is unlikely, and delamination or other damage of these edges is as good as excluded. Moreover, such edge region renders the visual illusion that the panel has a thicker wooden top layer. Preferably, the aforementioned lower edge region forms a bevel or other chamfer, wherein the wood veneer extends over the lower edge region at least up to a point where the veneer surface is situated on a level in a horizontal plane which intersects the aforementioned substrate.

In the case of an oblong rectangular floor panel, said lower edge regions preferably are provided at least on the opposite long edges and possibly additionally on the opposite short edges, however, not necessarily. The short edges also may be free from lower edge regions.

Preferably, the aforementioned wood veneer is compressed on one or more edges. This can be obtained, for example, by forming lower edge regions at the respective edges by an impression of the veneer and preferably also of underlying layers, such as the substrate. When performing such impression, preferably also the aforementioned layer of thermosetting resin hardens, such that the springing back of the impressed material may remain limited. Providing compressed wood veneer on the edges leads to an increased resistance against moisture penetration. It is in particular advantageous when at least the edges of the end faces of the wood veneer are compressed.

Preferably, the layer on the basis of thermosetting resin mentioned in the aspects extends uninterruptedly underneath the entire wood veneer. In the case that the wood veneer extends on lower edge regions of the veneer, the thermosetting resin preferably also extends on these lower edge regions, such that a good adherence of the veneer is obtained and a possible springing back of compressed material is limited.

Preferably, on the underside of the substrate a backing layer is provided, which also contains thermosetting resin, for example, a backing layer on the basis of a paper sheet impregnated with resin, or a backing layer on the basis of a wood veneer layer which is attached to the substrate with a thermosetting resin layer. This may relate, for example, to a veneer of spruce or pine. A backing layer of wood veneer preferably has a thickness of minimum 1 to 2 millimeters, for example, approximately 1.5 millimeters. Herein, this may relate to a veneer which is obtained by a rotative cutting treatment, or so-called "rotary peeled veneer".

For obtaining an optimum water resistance, the substrate and/or the wood veneer preferably is treated with a fluoro copolymer or a pMDI on one or more edges. This treatment preferably relates to a treatment of the end-side edges of the wood veneer and/or at least the substrate material immediately underneath the wood veneer. Such treatment can also be performed partially overlapping with the surface of the wood veneer. This is particularly interesting in the cases where the wood veneer extends at the respective edge over a lower-situated edge region. In those cases any disturbing effect of the overlap with the surface of the floor panel is less prominent, as it can be limited to a portion of the surface which is situated in this lower-situated edge region. Preferably, the overlap is limited to the portion which is situated immediately at the edge of the floor panel. So, for example, may the technique be applied which as such is known for laminate floor panels from EP 2 013 034 B1.

The glue layer mentioned in the aspects, possibly thermosetting resin layer, can be provided in the aforementioned stack in different manners. According to a first manner, the resin can be applied at least partially liquid on the basic board, for example, by one or more roller devices and/or spreading devices, after which it is dried to a residual moisture content of preferably less than 10 percent by weight. According to a preferred embodiment, the basic board is also applied for providing the hard particles in the stack, wherein these hard particles preferably are embedded in the dried glue or resin. According to a second manner, the resin can be provided on the basic board at least partially in powder form, for example, by one or more strewing devices. Preferably, this powder resin is fixed somewhat in the stack, for example, by nebulizing water thereon. The third hard particles, together with the resin, may form part of a powder mixture which is applied according to this second manner, or they can be separately provided in the stack, for example, by strewing them separately on or under the resin, or by bringing them into the stack by a carrier sheet. According to a third manner, the resin can be provided at least partially by a carrier sheet, such as a paper sheet. Preferably, it is started with a paper sheet having a weight between 15 and 150 grams per square meter, preferably between 50 and 100 grams per square meter, and still better of approximately 70 grams per square meter. The paper sheet preferably is opaque, possibly provided with a print. To the person skilled in the art, it is clear that the weight of the paper also contributes to the opacity. Of course, it is not excluded that a transparent paper sheet might be used, such as an alpha-cellulose paper without fillers, for example, of the type which is applied as an overlay in laminate floors. Such a paper sheet then typically has a weight of 15 to 30 grams per square meter. Such paper sheet then, prior to the step of composing the stack, can be impregnated with resin, preferably saturated with resin, and dried to a residual moisture content of preferably less than 10 percent by weight. The impregnated and dried sheet then is included in the stack.

Preferably, the step of pressing, of the second and third aspect, is performed in a heated press, for example, with a temperature of more than 80° C., and/or at least the upper surface of the basic board has a temperature of more than 60° C. during the step of pressing.

The wood veneers, which are included in the second and/or the third aspect of the invention in the stack mentioned there, possibly may be adhered to each other by sewing and/or glue connections, such that a veneer layer is obtained, portions of which are present in a plurality of the finally obtained floor panels. Preferably, the obtained floor panels are free from such sewing and/or glue connections, or anyhow at least free from such connections which would extend transverse to the longitudinal direction of the panel. Thus, preferably it is taken care that such connections in the pressed whole are situated on substrate material which has to be removed with dividing and/or profiling. According to a variant, a plurality of separate wood veneers are included in the stack and positioned next to each other, wherein the seam between adjacent wood veneers is situated on substrate material which has to be removed.

It is also noted that the forming of coupling structure(s) preferably is performed at least with machining tools, such as rotating milling tools. By the presence of third hard particles of exceptional average particle size, a more than normal wear may occur on the tools working on the upper edge of the panels. In such case, it can be advantageous, for treating one or more of the upper edges, to rely to laser cutting or ultrasonic treatment, such as respectively described in EP 1 851 020 and WO 97/13626. According to another possibility, the third hard particles can at least be omitted at the edges, or in the vicinity of the edges. In this manner, a normal wear of the tools can be expected.

It is further remarked that the thickness of the lacquer layer applied to the wood veneer preferably has a thickness smaller than the thickness of the wood veneer. Preferably the thickness of the lacquer layer is 200 micron or smaller. In the cases where the lacquer layer is made up of at least two sublayers, preferably each of the sublayers has a thickness that is 150 micron or less. In such case the uppermost sublayer may have a thickness of 40 micron or less.

According to a variant of any of the abovementioned aspects and/or preferred embodiments thereof, instead of a wood veneer, also other natural veneers can be used, such as veneers from grass such as bamboo, or natural stone veneer. According to another variant, different types of wood veneers, or different types of natural veneer can be combined on the same panel. For example wood and natural stone veneer may be combined on the surface of the same panel.

Even though sieve analysis is preferred for measuring the particle sizes and average particle sizes described in the context of the present invention, it is possible to use laser light scattering granulometry performed in accordance with ISO 13320 as an alternative. This concerns a dynamic light scattering technique using a laser having an emission wavelength of 632.8 nm and measured under a scattering angle of 90 degrees. Such granulometry may e.g. be performed with a Malvern® Mastersizer 2000 or with a Malvern® Mastersizer 3000. For executing the measurement of the particle size distribution, the respective particles may be dispersed in a liquid, such as water. The use of sieve analysis or laser granulometry has no bearing on the preferred ranges mentioned in the present disclosure.

BRIEF DESCRIPTION OF THE DRAWINGS

With the intention of better showing the characteristics of the invention, herein below, as an example without any limitative character, some preferred embodiments are described, with reference to the accompanying drawings, wherein:

FIG. 4, in a view similar to that of FIG. 2, represents a variant;

FIG. 5, at a larger scale, represents the floor panel of FIG. 4 in coupled condition;

DETAILED DESCRIPTION OF THE DRAWINGS

Figure 1:
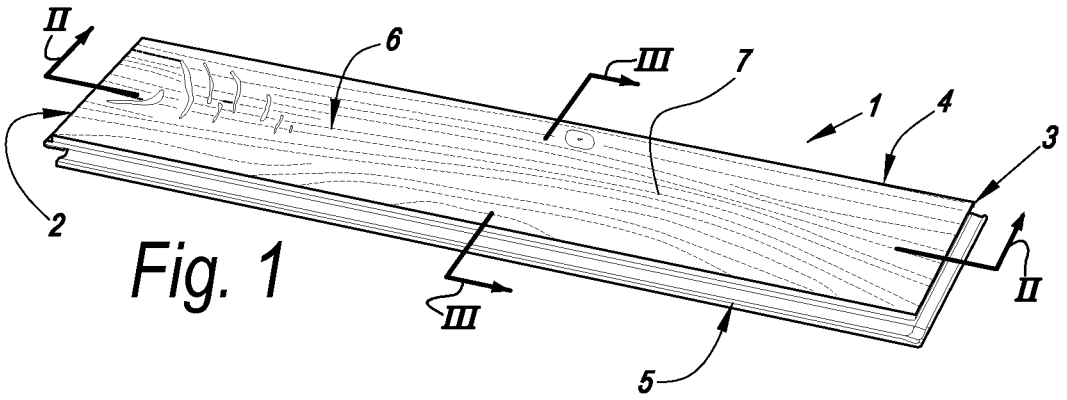
FIG. 1 in perspective represents a floor panel with the characteristics of the invention.

FIG. 1 represents a decorative panel, more particularly a floor panel 1, in accordance with the invention. The panel 1 is rectangular and oblong and comprises a pair of opposite short edges 2-3 and a pair of opposite long edges 4-5. The decorative top layer 6 is formed by a wood veneer 7 with a thickness of 1 millimeter or less, in this case the veneer has a thickness T1 of approximately 0.6 millimeters.

Figure 2:
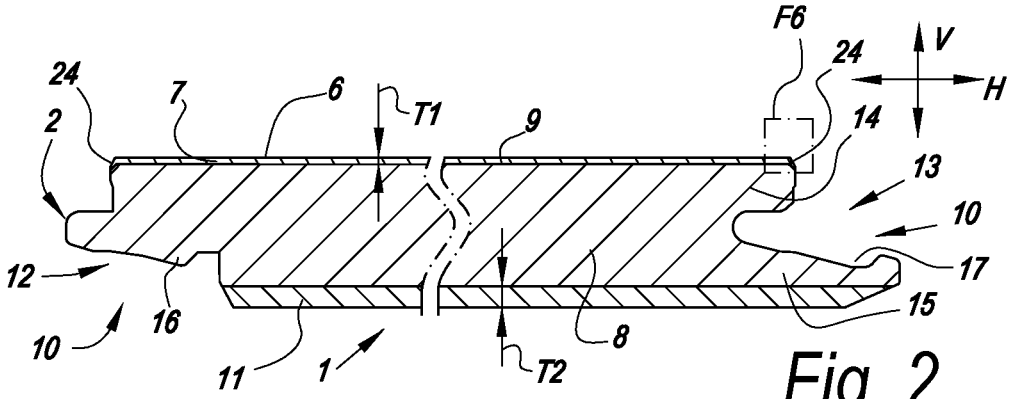
FIGS. 2 and 3, at a larger scale, represent a cross-section according to the lines II-II and III-Ill, respectively, represented in FIG. 1.

FIG. 2 clearly shows that the decorative panel 1 comprises a substrate material 8 on which the wood veneer 7 is provided by a layer on the basis of thermosetting resin 9, situated between the substrate and the decorative layer. In the example, the substrate 8 has an average density of more than 750 kilograms per cubic meter. In this case, this relates to an HDF board material with an average density of 900 kilograms per square meter and a surface density of more than 1000 kilograms per square meter. At the edges 2-3 and 4-5, mechanical coupling structure(s) 10 are formed in the substrate material by milling cutters. At the underside of the substrate material 8, a backing layer 11 is provided, for example, glued or otherwise attached to the substrate material 8. According to a preferred embodiment of the invention, such backing layer 11 is also attached to the substrate material 8 by a layer of thermosetting resin. Such backing layer 11 preferably is made of a wooden veneer layer with a thickness T2 of at least 50 percent of the decorative top layer. Still better, the decorative top layer of the wood veneer 7 and the backing layer 11 differ from each other at least in that the wood veneer of the backing layer 11 is thicker than the wood veneer 7 of the top layer. The backing layer 11 may consist, for example, of a "rotary peeled veneer" with a thickness T2 of 1.5 millimeters or thicker, whereas the wood veneer 7 of the top layer is a veneer with a thickness T1 of less than 1 millimeter.

Figure 3:
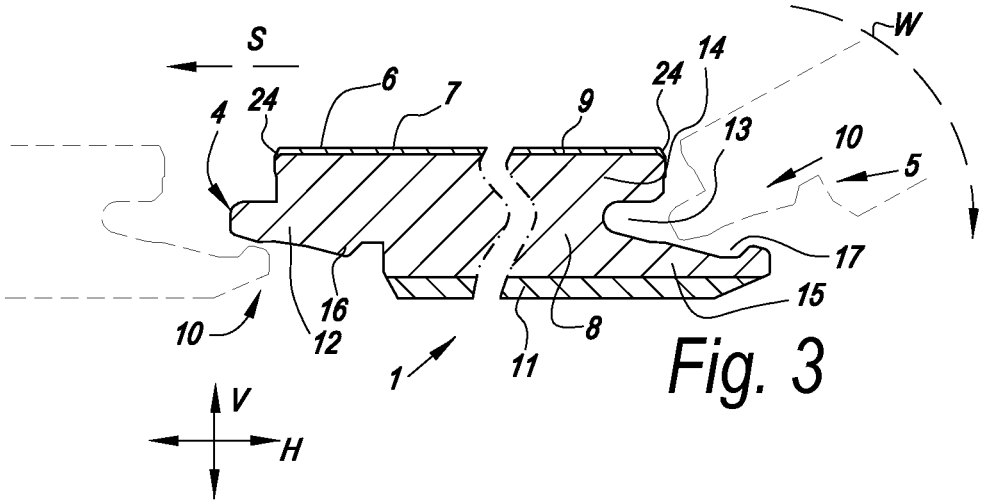

FIGS. 2 and 3 represent that both pairs of opposite edges 2-3-4-5 are provided with mechanical coupling structure(s) 10 which substantially are realized as a tongue 12 and a groove 13 bordered by an upper lip 14 and a lower lip 15, wherein the tongue 12 and the groove 12 substantially are responsible for the locking in a vertical direction V, and wherein the tongue 12 and the groove 13 are provided with additional locking parts 16-17, which substantially are responsible for the locking in a horizontal direction H. Preferably, the locking parts comprise a protrusion 16 at the underside of the tongue 12 and a recess 17 in the lower groove lip 15. The coupling structure(s) represented in FIGS. 2 and 3 allow at least a coupling by an angling or rotational movement W around the respective edges 2-3-4-5 and/or a coupling by a shifting movement S in a substantially horizontal manner of the edges 2-3-4-5 to be coupled towards each other.

FIGS. 4 and 5 represent a variant with a pair of short edges 2-3, which allow obtaining a coupling at least by a downward movement D. An edge 2 is provided with a male coupling part 18, whereas the other edge 3 is provided with a female coupling part 19. By the downward movement D the male coupling part 18 is pressed into the female coupling part 19 in order to be locked there in the vertical direction V, as a result of a pair of cooperating protrusions 20 and recesses 21. In this case, the recess 21 is partially formed by a resilient element 22 present in the female coupling part 19.

Figure 6:
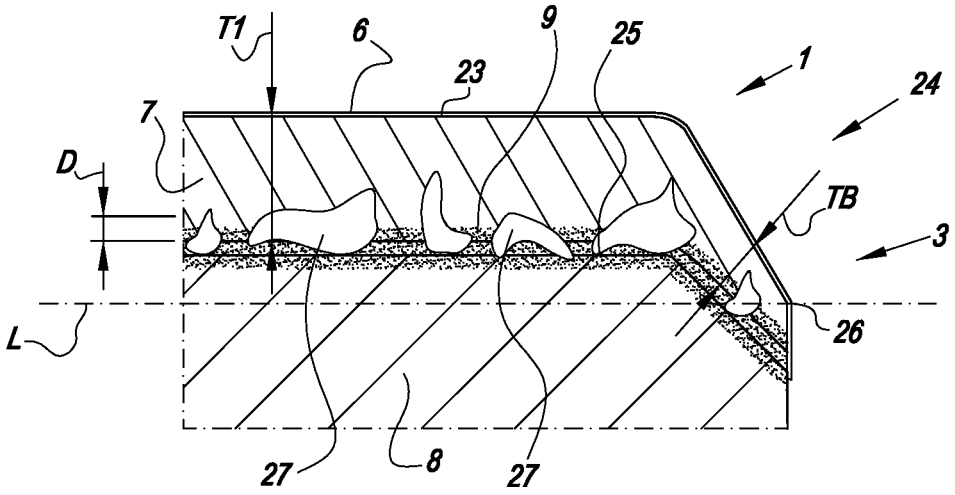
FIG. 6, at a larger scale, shows a view onto the region indicated by F6 in FIG. 2.

FIG. 6 represents a detail of the upper edge of the floor panel from FIG. 2. It is shown clearly that the layer of thermosetting resin 9 can penetrate partially into the substrate material 8 and partially into the wood veneer 7 of the top layer.

FIG. 6 further clearly shows that the decorative layer 6 at the surface comprises a lacquer layer 23 of a transparent or translucent surface material. In this case, this relates to a material with a matte structure, namely with a gloss degree of 10 or less, as measured according to DIN 67530.

The floor panel from the FIGS. 1 to 6 is provided with lower edge regions 24 on one or more edges 2-3-4-5, wherein the wood veneer 7 extends in one piece from on the surface 25 of the substrate 8 over these lower edge regions 24. In the example, the lower edge regions 24 are realized as bevel or chamfer. The wood veneer 7 extends over the lower edge region 24 at least up to a point 26, wherein the veneer surface is situated at a level L in a horizontal plane which intersects the aforementioned substrate 8. At the location of the lower edge regions 24, the wood veneer 7, seen on average, has a thickness TB which is smaller than the global thickness T1 of the wood veneer 7. At these edges, the wood veneer 7 is compressed or impressed. In the present case, also the substrate material 8 is impressed at the location of these edges. This compression of the wood veneer 7 leads to an increased resistance against moisture penetration. Preferably, the average thickness TB of the wood veneer on the lower edge regions is less than 85% of the global thickness T1 of the wood veneer. Instead of working with a compressed wood veneer 7, in accordance with a not represented embodiment, a lower edge region may be created by removing an amount of material from the veneer 7 at the respective edge. Such is preferably executed before application of the lacquer 23.

Figure 7:
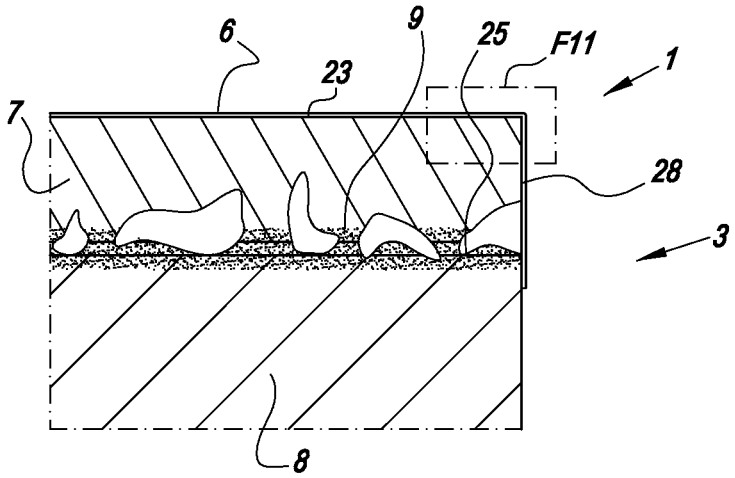
FIG. 7, in a view similar to that of FIG. 6, represents a variant.
Figure 8:
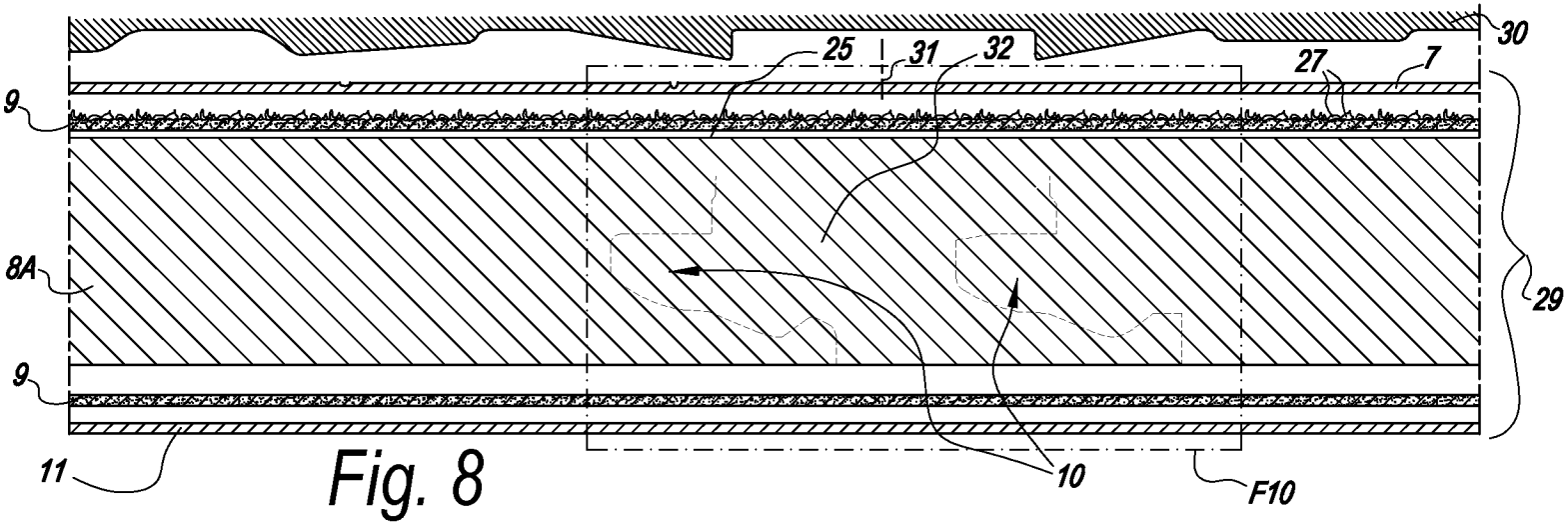
FIGS. 8 and 9 illustrate a step in a method with the characteristics of the invention.

FIG. 7 represents a variant of the floor panel of the FIGS. 1 to 6, where such lowered edge regions are absent, or where, in other words, the wood veneer 7 extends to one or more or all of the edges 2-3-4-5 of the floor panel 1 in a substantially horizontal manner.

In the examples, the thermosetting resin 9 extends uninterruptedly underneath the entire wood veneer 7, inclusively the lower edge regions 24.

The surface material 23 follows the relief of the wood veneer 7 at least over the lowered edges 24 or chamfers.

FIG. 6 schematically represents that the thermosetting resin 9 or the glue layer comprises third hard particles 27. In this example, the third hard particles 17 show an average particle size which is at least one third of the thickness T1 of the wood veneer 7. These particles penetrate at the underside into the wood veneer 7 and there provide for a barrier against the final wearing through of the veneer 7. Due to the choice of the average particle size, the particles 27 penetrate from on the underside into the veneer 7 over a distance which is larger than the distance D, wherein the distance D is 20% of the thickness T1 of the wood veneer 7.

In accordance with the first aspect of the invention, also in the surface material of the lacquer 23 there are wear-resistant particles, however, with a smaller average particle size, for example, of 10 micrometers or smaller.

FIGS. 6 and 7 represent that, in accordance with the first aspect of the invention, the lacquer 23 at least partially covers a side edge 28 of the wood veneer 7. In this case it concerns the side edge 28 of the wood veneer 7 formed at a short edge 3 of the panel 1. The wood veneer 7, as illustrated on FIG. 1, has been cross cut, and may have open wood vessels, which are sealed by the lacquer 23.

Figure 9:
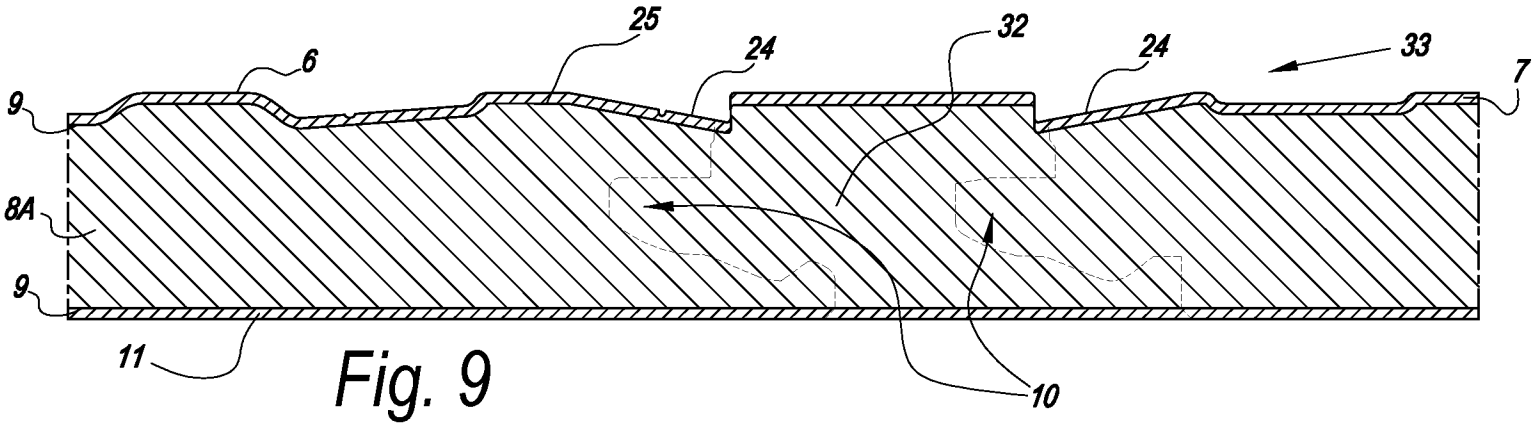

FIG. 9 represents a pressing step in a method for manufacturing, e.g. the panels of FIGS. 1 to 6. A stack 29, comprising the wood veneer 7 and a basic board 8A, is pressed. For the press treatment in this case a structured press element 30 is applied. The stack 29 comprises a basic board 8A with an average density of more than 750 kilograms per cubic meter, a layer of thermosetting resin 9 and a wood veneer 7 for forming the decorative top layer 6. Further, the stack 29 also comprises a wood veneer for forming the backing layer 11 and a layer of thermosetting resin 9 for attaching this backing layer 11 to the underside of the basic board 8A. In the figure, the layers with thermosetting resin 9 are shown in exploded view, but are in reality applied to the surface 25 of the basic board 8A, for example by a roller application. The wood veneer 7 comprises a sewing connection 31, which is positioned above a portion 32 of the basic board 8A, which has to be removed in subsequent treatments for subdividing and profiling or forming of coupling structure(s) 10, which here already are represented in dashed line. In the example, the basic board 8A comprises a flat upper surface 25. However, it is not excluded that the upper surface may be pre-formed, entirely or partially, corresponding to the applied press element 30.

Figure 10:
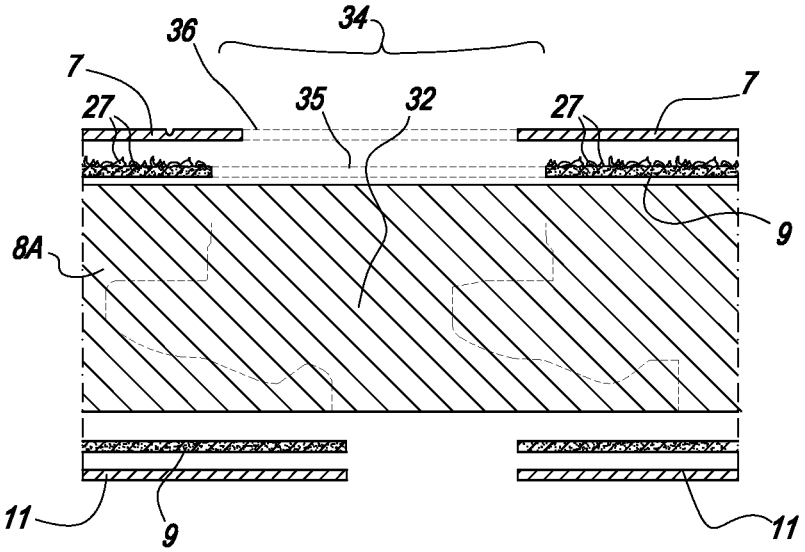
FIG. 10 represents a variant in a view onto the region indicated by F10 in FIG. 8.

FIG. 10 represents the obtained pressed whole 33. Herein, the decorative top layer 6 and the backing layer 11 is represented only schematically each time as one layer, namely without representing the layers with resin 9. From this, it is clear that the veneer 7 and the backing layer 11 are adhered to the basic board 8A by the hardened resin 9. Moreover, the basic board 8A is deformed such that the upper surface 25 shows a structure. The wood veneer 7 follows the contour of the structured upper surface 25. Hereby, in this case, it is obtained that the wood veneer 7 comprises a relief of scraped parquet with lowered edges 24.

FIG. 10 represents that at least the third hard particles 27 can remain absent at the location of the portion 32. In this manner it is achieved that the cutting tools, which have to remove the portion 32 in order to form the coupling structure(s), are less subjected to wear. In this case, an embodiment is represented wherein the resin 9 and the hard particles 27 are areawise applied to the stack 29, ie in areas with an intermediate space 34. Herein, the space 34 is situated above the portion 32 and in this case extends at least over this entire portion. According to the variant represented in dashed line it is also possible that the resin 9 extends continuously over the portion 32, however, that the third hard particles 27 remain absent there or anyhow at least are present to a much more limited extent.

FIG. 10 further represents that, whether or not in combination with the above, a plurality of wood veneers 7 situated next to each other can be applied instead of veneers which are composed, via a sewing connection, to a continuous sheet. Preferably, between the wood veneers 7 a space is maintained at the location of the portion 32. The dashed line 36 represents a continuous sheet which may or may not have a seam for example due to a sewing connection 31.

FIG. 10 further also represents that there are similar options for the glue layer at the underside and for the backing layer 11.

Referring to FIGS. 9 to 10, it is clear that the press treatment preferably is performed on a larger basic board 8A, which finally shall be subdivided into a plurality of floor panels 1. In transverse direction as well as in longitudinal direction, a plurality of floor panels 1 lying next to each other can be formed from the larger basic board 8A. The portions 32 of the basic board 8A can be present between adjacent long edges 4-5 as well as between adjacent short edges 2-3 of the final floor panels 1.

Preferably subsequent to the dividing operation the lacquer layer 23 is applied to the surface of the wood veneer 7 and to the side edge 28 of the wood veneer 7.

Figure 11:
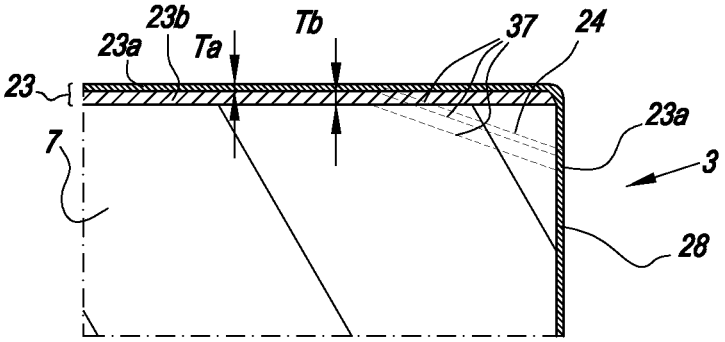
FIG. 11 on a larger scale represents another variant of a floor panel in a view similar in accordance with the are indicated as F11 on FIG. 7.

FIG. 11 shows an embodiment where the lacquer layer 23 comprises at least two sublayers 23*a*-23*b*. In the example, only the uppermost sublayer 23*a* covers a part of the side edge 28 of the wood veneer 7. The other of the two sublayers 23*b* extends up until the upper edge of the wood veneer 7. Preferably, both the uppermost sublayer 23*a* and the other sublayer 23*b* comprise hard particles, not shown here. Preferably the hard particles of the uppermost sublayer 23*a* are of a smaller average particle size than the hard particles of the other sublayer 23*b*. Preferably the uppermost sublayer 23*a* has a thickness Ta which is smaller, preferably at least 30% smaller, than the thickness Tb of the other sublayer 23*b*.

FIG. 11 further illustrates by the dashed lines 37 that a lowered edge 24 can be realized by removing an amount of material from the wood veneer 7 at the respective edge 3. Preferably the lacquer layer 23 is available on the surface of the lowered edge 24, and preferably at least the uppermost layer 23*a*—in this case only the uppermost layer 23*a*—extends over the upper edge to cover at least a part of the side edge 28 of the wood veneer 7.

The present invention is in no way limited to the herein above-described embodiments, on the contrary can such methods and decorative panels be realized according to various variants, without leaving the scope of the present invention. Amongst others, it is clear that the characteristics of the invention of any aspect also are interesting with other decorative panels, such as furniture panels, wall panels or ceiling panels. So, for example, does the invention offer the possibility for more wear-resistant counter tops for kitchens, office furniture, tables and the like, which comprise only a thin veneer layer as a decorative layer.

Although in the above practically exclusively wood veneer is mentioned, it is evident that the above independent aspects and preferred embodiments thereof also are applied in decorative panels with a thin top layer of another material. So, for example, it can be applied in decorative top layers of leather, bamboo, textile, aluminum, metal, stone veneer, plastic foils or the like.

The invention claimed is:

1. A floor panel comprising:

a substrate;

a decorative layer of wood veneer on the substrate, the wood veneer comprising an upper surface and a side edge, wherein the side edge is formed by a cross cut through the wood veneer, and wherein the wood veneer has a thickness of 1 millimeter or less; and a lacquer layer comprising a transparent or translucent surface material on the wood veneer;

wherein the lacquer layer comprises hard particles; and wherein the lacquer layer extends from the upper surface of the wood veneer at least up to the side edge of the wood veneer, such that the side edge is at least partially covered by the lacquer layer.

2. The floor panel of claim 1, wherein the lacquer layer comprises at least two sublayers, wherein at least an uppermost sublayer of the at least two sublayers at least partially covers the side edge.

3. The floor panel of claim 2, wherein the uppermost sublayer comprises the hard particles, while another sublayer of the two sublayers is free from hard particles.

4. The floor panel of claim 2, wherein the hard particles comprise first hard particles in the uppermost sublayer, and second hard particles in another of the two sublayers.

5. The floor panel of claim 4, wherein the second hard particles have an average particle size that is larger than an average particle size of the first hard particles, wherein the average particle size of the second hard particles is at least 2 times larger than the average particle size or the first hard particles.

6. The floor panel of claim 4, wherein the first hard particles have an average particle size of 30 micron or below, or of 15 micron or below, and wherein the second hard particles have an average particle size of 120 micron or below, or of 85 micron or below, or above 30 micron.

7. The floor panel of claim 1, wherein the decorative layer is provided on the substrate by a glue layer, wherein the glue layer is between the substrate and the decorative layer, wherein the glue layer comprises third hard particles.

8. The floor panel of claim 7, wherein the third hard particles have an average particle size that is larger than an average particle size of the first hard particles, wherein the average particle size of the third hard particles is at least 3 times larger than the average particle size or the first hard particles.

9. The floor panel of claim 7, wherein the third hard particles have an average particle size that is at least one third of the thickness of the wood veneer, or less than two thirds of the thickness of the wood veneer.

10. The floor panel of claim 7, wherein the third hard particles have an average particle size above 120 micron, or above 180 micron.

11. The floor panel of claim 7, wherein the third particles have an average particle size above 200 micron.

12. The floor panel of claim 7, wherein the wood veneer is at least partially impregnated by the thermosetting resin.

13. The floor panel of claim 7, wherein the third hard particles at an underside of the decorative layer penetrate into the wood veneer.

14. The floor panel of claim 7, wherein the third hard particles comprise particles penetrating into the wood veneer at an underside over a distance of at least 20% of the thickness of the wood veneer.

15. The floor panel of claim 14, wherein the third hard particles penetrate for 30% by weight or more of the third hard particles at the underside into the wood veneer over a distance of at least 20% of the thickness of the wood veneer.

16. The floor panel of claim 1, wherein the substrate is a wood fiberboard, or an HDF wood fiberboard.

17. The floor panel of claim 1, wherein the wood veneer has a thickness between 0.3 and 1 millimeter, or between 0.45 and 0.7 millimeters, or approximately 0.6 millimeters.

18. The floor panel of claim 1, wherein the substrate, at the surface where the decorative layer is situated, has a density of more than 900 kilograms per cubic meter.

19. A method for manufacturing floor panels that comprise at least a substrate and a decorative layer of wood veneer on the substrate, the method comprising:

providing a basic board;

providing one or more wood veneers that each comprise an upper surface and a side edge, which is obtained by a cross cut through the one or more wood veneers;

composing a stack comprising at least the basic board, a glue layer, and the one or more wood veneers;

pressing the stack, such that the one or more wood veneers are adhered to the basic board and producing a pressed stack;

dividing the pressed stack into a plurality of panels, and potentially profiling edges of the plurality of panels obtained; and subsequent to the dividing and potentially subsequent to the profiling, applying a lacquer layer comprising a transparent or translucent surface material on the wood veneer;

wherein the lacquer layer comprises hard particles; and wherein the lacquer layer extends from the upper surface of the wood veneer at least up to the side edge of the wood veneer, such that the side edge is at least partially covered by the lacquer layer.

20. The method of claim 19, wherein the method is applied for manufacturing a floor panel comprising:

the substrate;

the decorative layer of wood veneer provided on the substrate, the wood veneer, wherein the wood veneer has a thickness of 1 millimeter or less; and the lacquer layer.

21. A floor panel comprising:

a substrate;

a decorative layer of wood veneer on the substrate, the wood veneer comprising an upper surface and a side edge, wherein the wood veneer has a thickness of 1 millimeter or less; and a lacquer layer comprising a transparent or translucent surface material on the wood veneer;

wherein the lacquer layer comprises hard particles;

wherein the lacquer layer extends from the upper surface of the wood veneer at least up to the side edge of the wood veneer, such that the side edge is at least partially covered by the lacquer layer; and wherein the lacquer layer comprises at least two sublayers, at least an uppermost sublayer of the at least two sublayers at least partially covering the side edge.

* * * * *